US007188756B1

(12) United States Patent
Storm

(10) Patent No.: US 7,188,756 B1
(45) Date of Patent: Mar. 13, 2007

(54) QUILTING ACCESSORY

(76) Inventor: Henriëtte C. Storm, Plataanstraat 6, 2691 TZ's - Gravenzonde (NL)

( * ) Notice: Subject to any disclaimer, the term of this patent is extended or adjusted under 35 U.S.C. 154(b) by 261 days.

(21) Appl. No.: 10/835,512

(22) Filed: Apr. 28, 2004

(51) Int. Cl.
*D05B 91/04* (2006.01)

(52) U.S. Cl. ..... 223/101

(58) Field of Classification Search ..... 223/99, 223/101; 2/21, 163; D3/29, 26, 22, 18; D11/3, 27

See application file for complete search history.

(56) References Cited

U.S. PATENT DOCUMENTS

| | | | | | |
|---|---|---|---|---|---|
| 1,057,496 | A | * | 4/1913 | Palter | 223/101 |
| 3,191,824 | A | * | 6/1965 | Burr | 223/101 |
| 3,722,763 | A | * | 3/1973 | Heinz | 223/101 |
| 3,728,736 | A | * | 4/1973 | Pugh | 2/21 |
| 4,102,480 | A | * | 7/1978 | O'Beirne-Ranelagh | 223/101 |
| D270,966 | S | * | 10/1983 | Lynn | D3/29 |
| 4,534,495 | A | | 8/1985 | Adkins | 223/101 |
| 4,720,026 | A | | 1/1988 | Feuerman | 223/102 |
| 4,899,916 | A | * | 2/1990 | Townsend | 223/101 |
| 4,998,651 | A | | 3/1991 | Townsend | 223/101 |
| D327,772 | S | * | 7/1992 | Orr | D3/29 |
| 5,732,862 | A | * | 3/1998 | Bull | 224/217 |
| 6,409,059 | B1 | | 6/2002 | Calvert | 223/101 |
| 6,640,341 | B1 | | 11/2003 | Calvert | 2/161.6 |

OTHER PUBLICATIONS

A package for a Slip-Free Thimble by Clover Needlecraft, Inc., Carson, CA 90746.

* cited by examiner

*Primary Examiner*—Gary Welch
*Assistant Examiner*—Andrew W. Sutton
(74) *Attorney, Agent, or Firm*—Renner, Kenner, Greive, Bobak, Taylor & Weber

(57) ABSTRACT

A quilting accessory (10) includes a ring portion (12) that is adapted to be received around a human digit, and a cup portion (14) that is carried by ring portion (12) and is adapted to engage and manipulate a sewing needle (N). The cup portion (14) is preferably conically shaped and the ring portion (12) is preferably made of a flexible material and split to form an opening (22) so that the size of the ring portion (12) can be adjusted.

11 Claims, 3 Drawing Sheets

QUILTING ACCESSORY

TECHNICAL FIELD

The present invention relates to a quilting accessory. More particularly, the present invention relates to a quilting accessory that can be worn on a thumb and that includes a ring portion and a cup portion that is adapted to engage and manipulate a needle during a quilting process.

BACKGROUND ART

Quilting has been practiced for centuries. Generally, quilting is the process of stitching through layers of cloth. In one common type of quilt, a plurality of squares or rectangles of colored cloths are sewn together around their peripheries to form a decorative top sheet. The top sheet is overlaid on a liner, such as flannel or batting, and a bottom sheet, and these laminations are then stitched together to form the entire quilt. The stitches preferably form a uniform pattern across the entire area of the quilt. This can require thousands of stitches that are often made by hand by a human quilter.

Alternatively, the top sheet may be a full sized sheet with an attractive decoration. This top sheet is then quilted by hand-stitching it to one or more cloth laminations. The stitches are generally arranged in a decorative and often elaborate pattern.

In either event, thousands of hand stitches are required to complete a quilt and, in each stitch, the quilter must make sure that the needle penetrates all of the cloth laminations and then returns through the cloth laminations at a distance closely spaced from the point of entry so as to preferably give a relatively small stitch.

Thimbles are often used both for protecting the finger from needle points as well as for pushing needles through multiple layers of material. Conventional thimbles are worn on a digit other than a thumb, typically on an index finger or middle finger. The thimble surface is most often roughened to prevent deflection of the needle from the curved thimble surface. Instead of passing the needle entirely through the cloth laminations, regrasping it on the underside of the cloth laminations and reinserting it on the return path through the laminations, the quilter generally pushes the needle point through the cloth laminations in engagement with the thimble and then rotates the needle relative to the cloth so as to point the needle upwardly so that it may be pushed back through the cloth laminations.

Even when the thimble surface is roughened however, conventional thimbles do not allow manipulation of the needle with any significant level of accuracy and precision. Moreover, conventional thimbles allow stitches to be made only in very limited directions. Therefore, in order to achieve the intricate stitching designs found on quilts, the fabric must be rotated. When a large quilt is being stitched together, however, the fabric is stretched on a stationary frame, and the fabric cannot be rotated. In this case, the quilter must change position relative to the fabric in order to achieve stitches in different directions. As a result, attempting to produce uniform, aesthetically pleasing stitches of an intricate pattern in many directions can be awkward and physically stressful.

Thus, a need exists for a quilting accessory for effecting the hand stitching of a plurality of cloth laminations to provide accurate and precise manipulation of a needle to produce uniform stitches in a wide range of directions without the necessity of rotating the cloth.

DISCLOSURE OF THE INVENTION

It is thus an object of the present invention to provide a simple, yet versatile and very effective, quilting accessory that can be used to manipulate a needle toward a variety of angles and push a needle through a plurality of layers of fabric to produce a stitch.

It is another object of the present invention to provide a quilting accessory, as above, that can be used in a variety of positions to allow precise needlework in relatively confined areas.

It is yet another object of the present invention is to provide a quilting accessory, as above, that can be easily adjusted to fit a variety of finger sizes.

It is yet another object of the present invention to provide a quilting accessory, as above, that can be used effectively to produce straighter rows and smaller stitches than are normally produced using a standard thimble, with less physical strain.

It is still another object of the present invention to provide a quilting accessory, as above, that can be worn on a thumb, thereby allowing stitching in directions not normally achievable with conventional thimbles.

It is yet another object of the present invention to provide a quilting accessory, as above, that can be worn on a thumb and that leaves the tip of the thumb unencumbered and able to perform tasks such as picking things up, threading needles, using scissors, and other tasks that are not possible when a conventional thimble is worn.

These and other objects of the present invention, as well as the advantages thereof over existing prior art forms, which will become apparent for the description to follow, are accomplished by the improvements hereinafter described and claimed.

In general, a quilting accessory made in accordance with the present invention includes a ring portion adapted to be received around a digit of the user, and a cup portion carried by the ring portion. The cup portion is adapted to engage and manipulate a needle during a quilting process.

A preferred exemplary quilting accessory incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
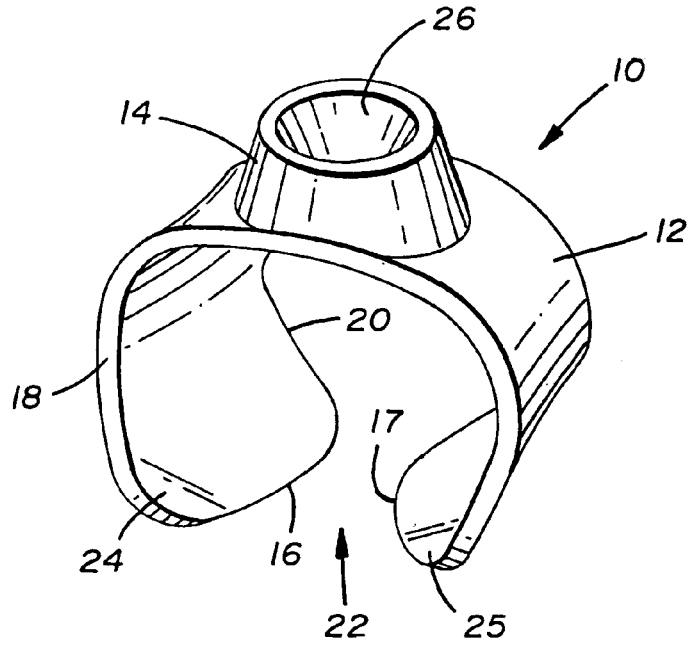
FIG. 1 is a perspective view of a quilting accessory made in accordance with the present invention.
Figure 2:
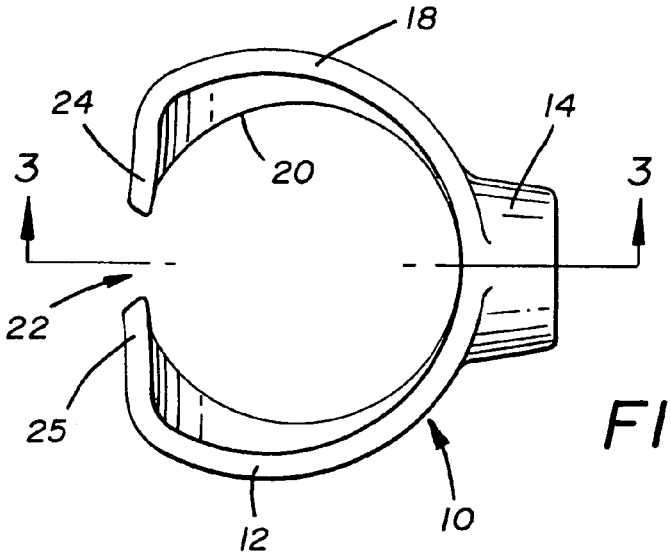
FIG. 2 is a side elevational view of the quilting accessory of FIG. 1.
Figure 3:
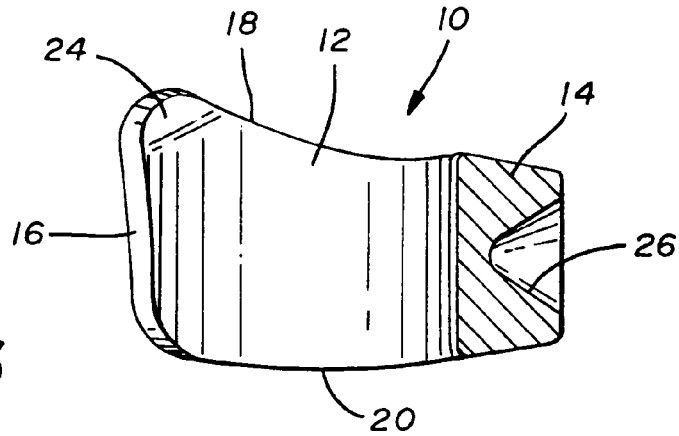
FIG. 3 is a sectional view taken substantially along the line 3—3 of FIG. 2.

A quilting accessory made in accordance with the present invention is generally indicated by the numeral 10, and is shown in FIGS. 1–3. Accessory 10 includes a ring portion 12 and a cup portion 14. Ring portion 12 includes two opposed ends 16, 17. Ring portion 12 further includes a front curved edge 18 and a rear curved edge 20. Opposed ends 16, 17 are spaced to define an opening 22 in the otherwise closed curve formed by ring portion 12.

The width of the ring portion, which may be defined as the distance between front curved edge 18 and rear curved edge 20, is not necessarily consistent and can vary along the length of ring portion 12. For example, ring portion 12 may be wider at each opposed end 16, 17. As such, each opposed end 16, 17 preferably includes a flared tip 24, 25 along front curved edge 18. Flared tips 24, 25 preferably curve outward, thereby causing the circumference of the curve formed by front curved edge 18 to be greater than the circumference of the curve formed by rear curved edge 20 and giving quilting accessory 10 a slightly tapered configuration. For purposes of this specification, the term circumference refers to the distance around the perimeter of a curve, and does not imply that the curve must be circular.

Cup portion 14 is carried by ring portion 12 and preferably includes a conical interior surface 26 that is utilized to engage and manipulate a needle of the type typically used in quilting and other types of needlework, as will hereinafter be described in more detail.

Ring portion 12 is preferably made of a flexible material such that opposing ends 16, 17 can be moved toward or away from each other to decrease or increase the width of opening 22. It will be understood that when the width of opening 22 is decreased, the circumference of the closed curve formed by ring portion 12 is correspondingly decreased, and when the width of opening 22 is increased, the circumference of the closed curve formed by ring portion 12 is increased. The quilting accessory of the present invention is therefore adjustable to accommodate a wide range of different sized digits. Additionally, the flexibility of ring portion 12 ensures a comfortable fit with no pressure points.

The material used in ring portion 12 should be sturdy enough to maintain its shape once it is in place on the digit, ensuring a snug fit. The material is therefore not completely flexible but is only partially flexible. Malleable materials may be used. The shape can be adjusted as desired. The material should preferably be non-toxic and hypo-allergenic to human skin. Examples of partially flexible material include 9 karat gold, 14 karat gold, sterling silver, silver 925, brass, steel, and the like and mixtures thereof.

Cup portion 14 may be made of the same or different material as ring portion 12. Preferably, cup portion 14 is made of material that is sufficiently impervious to penetration by a sewing needle such that force may be applied to the eye end of the needle to push the needle through multiple layers of fabric.

Figure 4:
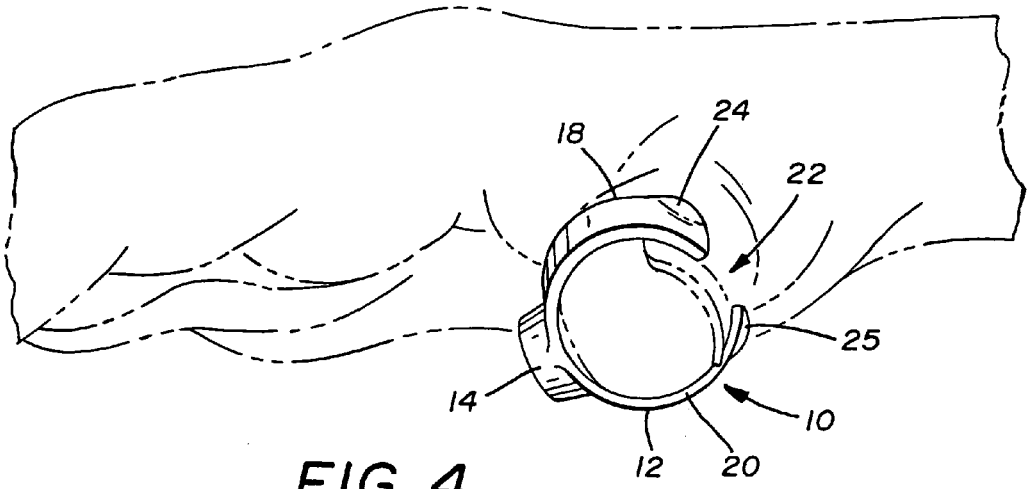
FIG. 4 is a perspective view of the quilting accessory of FIG. 1 shown in use positioned on a digit.

During use, the quilting accessory of the present invention encircles a digit on either the left or right hand of a human quilter. Preferably, the quilting accessory is worn on a thumb, for example as shown in FIG. 4. Advantageously, the tip of the digit remains unencumbered by the quilting accessory and therefore remains capable of picking things up, threading needles, using scissors and the like. In a preferred embodiment, where each opposed end 16, 17 includes a flared tip 24, 25, the quilting accessory conforms to the shape of the thumb, with flared tips 24, 25 resting against the knuckle of the thumb and the tapered quality preventing the quilting accessory from slipping further up on the thumb during use.

Figure 6:
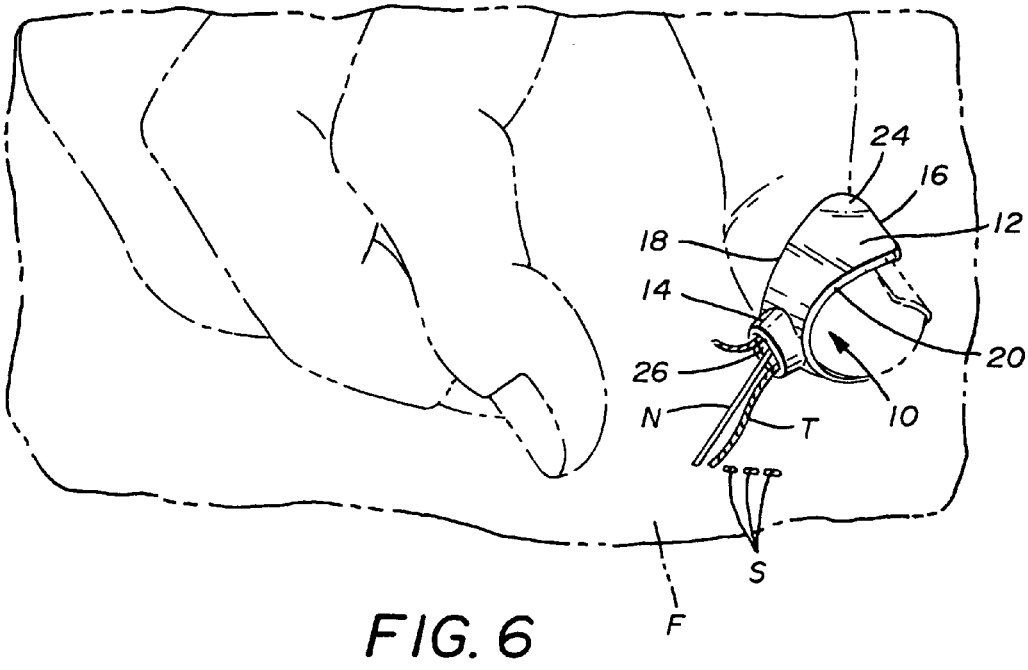
FIG. 6 is a perspective view like FIG. 4 but showing the quilting accessory manipulating the needle.
Figure 5:
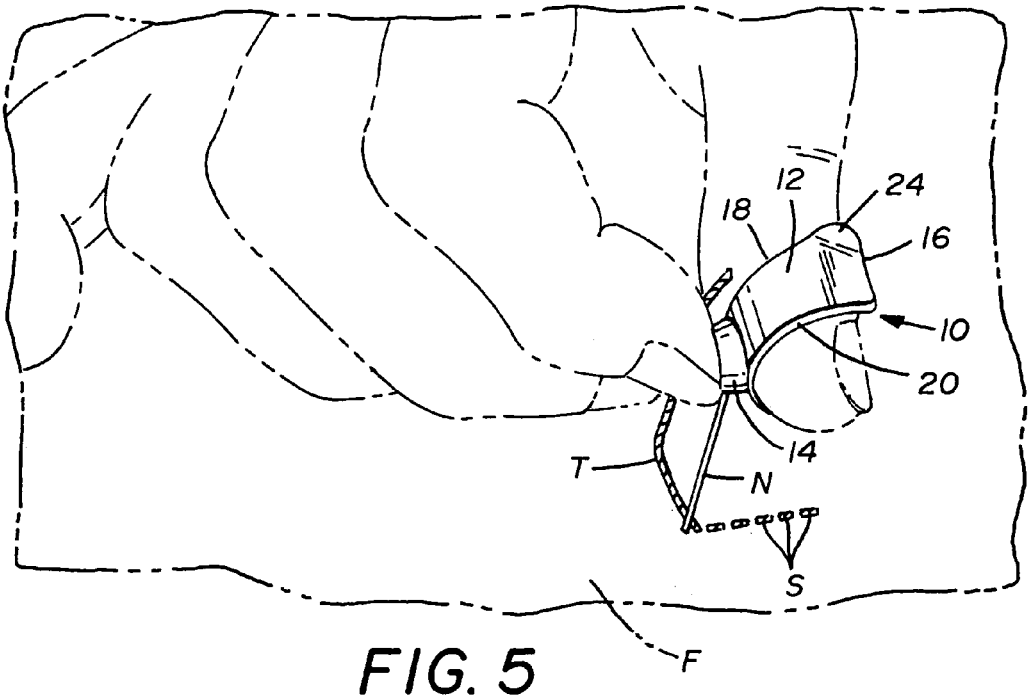
FIG. 5 is a perspective view like FIG. 4 and showing the quilting accessory engaging a needle.
Figure 7:
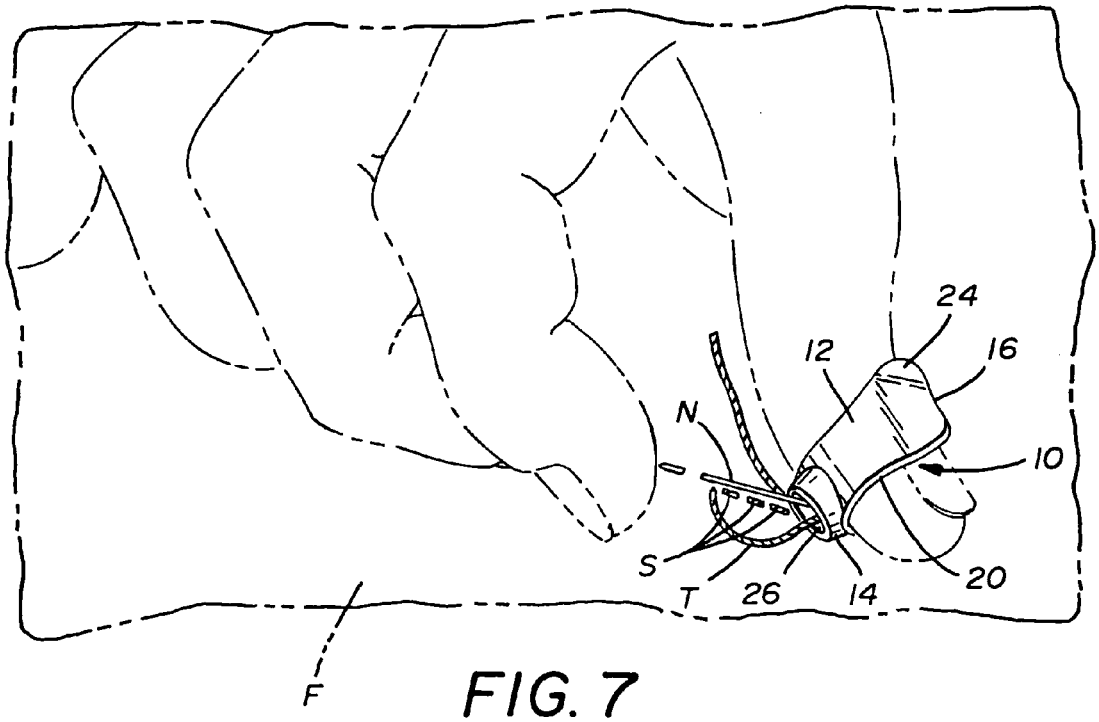
FIG. 7 is a perspective view like FIG. 4 but showing additional needle manipulations.

The manner is which accessory 10 is utilized to perform various quilting functions is shown in FIGS. 5–7. As shown, a quilt stitch S may be made by employing the quilting accessory of the present invention in conjunction with sewing needle N, thread T, and a plurality of layers of fabric F. Sewing needle N may be of conventional design, having an eye end containing an eye through which thread T may be strung, and a pointed end adapted for piercing fabric F. The quilting accessory is used by first placing the accessory on a thumb of one hand and then engaging the eye end of threaded sewing needle N with conical interior surface 26 of cup portion 14 of the accessory. Needle N may initially be held in place with another digit of the same hand as shown in FIG. 5. The pointed end of the sewing needle is pressed downward through all layers of fabric F to be quilted. Complete penetration of all layers of fabric by needle N may be verified by contact of the pointed end with an object located on the underside of the fabric. This object may be a fingertip, a thimble on a fingertip, a spoon or other device held by the quilter, or the like. Needle N may then be manipulated by moving the thumb and quilting accessory 10 in an arc motion from an upward position shown in FIG. 6 to a downward position as shown in FIG. 7, all the while keeping the eye end of needle N engaged with cup portion 14. As such, the eye end of needle N is adapted to freely move within, but be retained and guided or manipulated by cup portion 14. This arc motion brings the pointed end of needle N upward towards the underside of the layers of fabric. Pressure is then applied to the needle with the quilting accessory to push needle N upward through all layers of fabric. If only one stitch is desired, needle N may be pulled out of the fabric to tighten thread T and complete the stitch.

Multiple stitches may be made by pushing only the tip of the pointed end of needle N through the fabric, then using a plurality of upward and downward arc motions of the thumb and quilting accessory 10 to manipulate needle N upward and downward through the layers of fabric, with each pair of upward and downward arc motions instituting one stitch S. When the desired number of stitches have been instituted, needle N is pulled out of the fabric to tighten thread T and complete the stitches.

If desired, other quilting devices known in the art may be used in combination with the quilting accessory of the present invention. For example, when the quilting accessory is worn on a thumb, a conventional thimble may be worn on one or more opposing digits. The conventional thimble may be used both for protecting the fingers from needle points and for pushing needles through multiple layers of material to make stitches in the conventional manner. Furthermore, a needle puller may be used to aid in pulling the needle through the fabric to complete the stitches.

In light of the foregoing, it should thus be evident that a quilting accessory constructed as described herein substantially improves the art and otherwise accomplishes the objects of the present invention.

What is claimed is:

1. A quilting accessory comprising:

a ring portion adapted to be received around a digit of the user, wherein said digit of said user has a tip, and wherein the tip is unencumbered by the quilting accessory; and a cup portion carried by said ring portion, said cup portion being adapted to engage and manipulate a needle during a quilting process, wherein said cup portion includes an inner conical surface.

2. The quilting accessory of claim 1, wherein said ring portion is split providing opposed ends.

3. The quilting accessory of claim 2, wherein said ring portion includes a flared tip portion positioned at each of said opposed ends.

4. The quilting accessory of claim 3, wherein said flexible material comprises 9 karat gold, 14 karat gold, sterling silver, silver 925, brass, steel, or mixtures thereof.

5. The quilting accessory of claim 2, wherein said ring portion is made of a flexible material such that said opposed ends can be moved toward and away from each other to accommodate different sized digits.

6. The quilting accessory of claim 2, wherein said ring portion includes a first curved edge and a second curved edge.

7. The quilting accessory of claim 6, wherein said first curved edge defines a first curve and said second curved edge defines a second curve and wherein the circumference of said first curve is greater than the circumference of said second curve.

8. The quilting accessory of claim 6, wherein said ring portion includes a flared tip portion positioned at each of said opposed ends and located along said first curved edge.

9. The quilting accessory of claim 1, wherein said ring portion is not of a consistent width.

10. The quilting accessory of claim 1, wherein said ring portion is split providing opposed ends having flared tip portions and wherein the digit is a thumb, said flared tip portions engaging the thumb.

11. A quilting accessory comprising:

a ring portion adapted to be received around a digit of the user, said ring portion having a first edge separated from a second edge by a surface; and a cup portion carried by said surface, said cup portion being adapted to engage and manipulate a needle during a quilting process, wherein said cup portion includes an inner conical surface.

* * * * *